United States Patent [19]

Kurtz et al.

[11] 3,957,271

[45] May 18, 1976

[54] SELECTIVELY ADJUSTABLE DARTS

[75] Inventors: Ronald A. Kurtz, Englewood; Henry Utzinger, Ridgewood, both of N.J.

[73] Assignee: Kulite Tungsten Corporation, Ridgefield, N.J.

[22] Filed: Mar. 17, 1975

[21] Appl. No.: 558,967

[52] U.S. Cl. ..... 273/106.5 R
[51] Int. Cl.[2] ..... A63B 65/02
[58] Field of Search ..... 273/106.5 R

[56] References Cited

FOREIGN PATENTS OR APPLICATIONS

| | | | |
|---|---|---|---|
| 599,242 | 3/1948 | United Kingdom | 273/106.5 R |
| 419,323 | 11/1934 | United Kingdom | 273/106.5 R |
| 506,176 | 5/1939 | United Kingdom | 273/106.5 R |
| 546,079 | 6/1942 | United Kingdom | 273/106.5 R |
| 591,882 | 9/1947 | United Kingdom | 273/106.5 R |
| 135,316 | 11/1949 | Australia | 273/106.5 R |

*Primary Examiner*—Richard J. Apley
*Assistant Examiner*—Marvin Siskind
*Attorney, Agent, or Firm*—Arthur L. Plevy

[57] ABSTRACT

There is disclosed a composite game dart assembly wherein a point end has coupled thereto a barrel shaft upon which shaft, a plurality of annular weight members are emplaced, the barrel shaft is then coupled to a flight or feather accommodating assembly by means of a screw mechanism to enable a user to remove the flight accommodating assembly for the selective emplacement of the annular weights of different materials to control the overall weight and length characteristics of the dart assembly.

3 Claims, 5 Drawing Figures

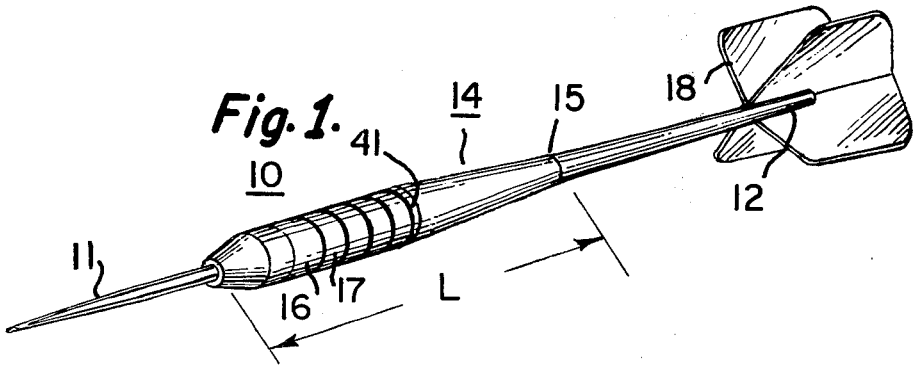
Fig. 1.
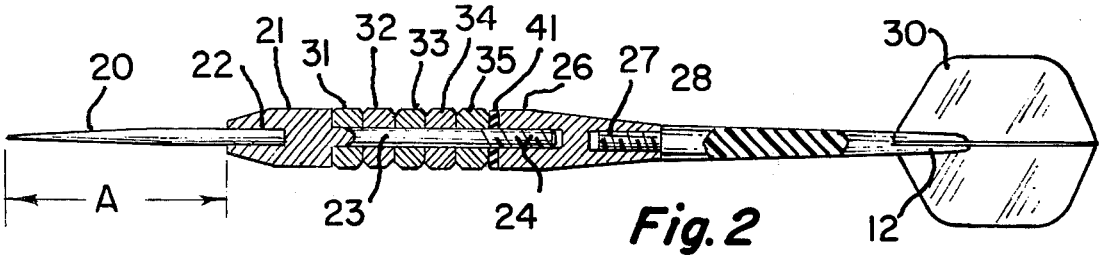
Fig. 2
Fig. 3A.
Fig. 3B.
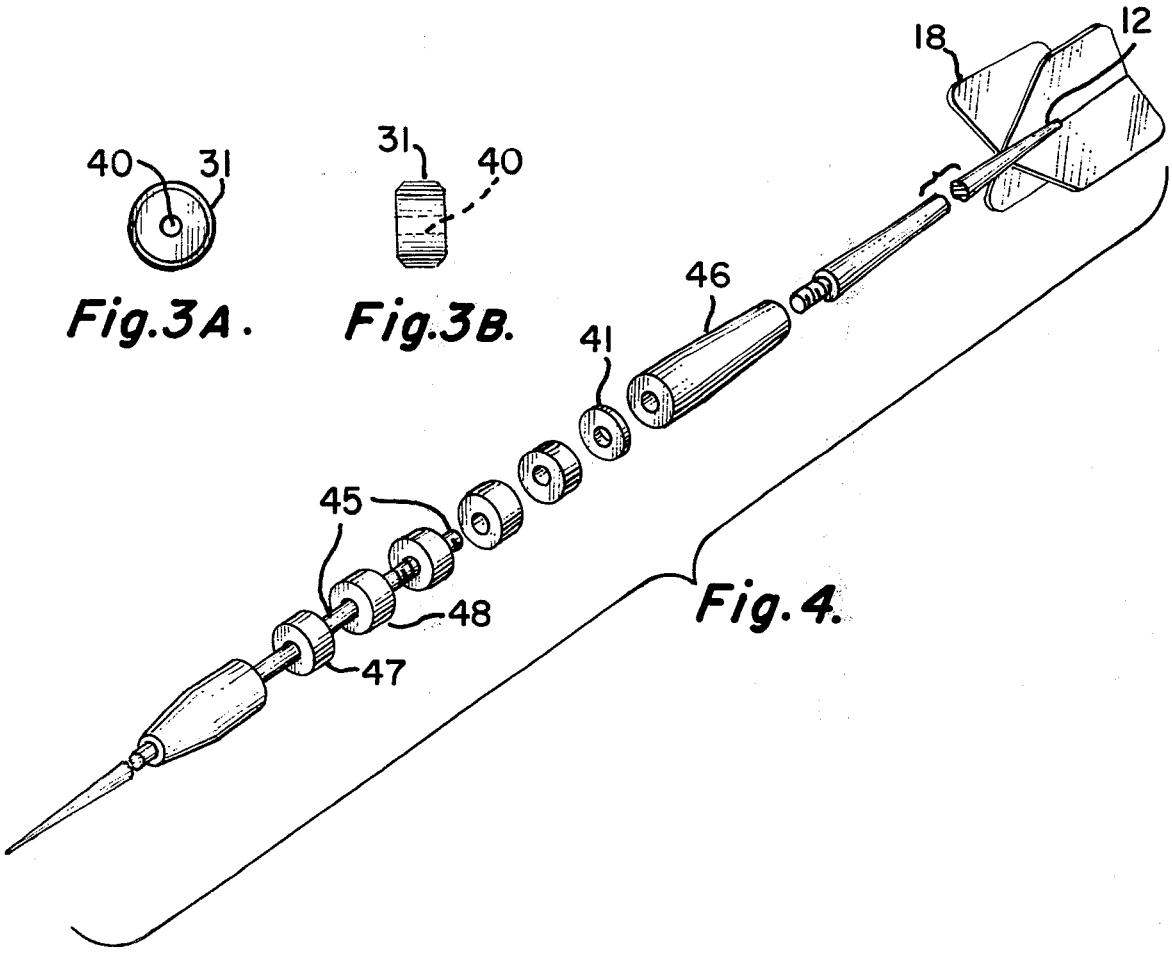
Fig. 4.

SELECTIVELY ADJUSTABLE DARTS

BACKGROUND OF INVENTION

This invention relates to darts, such as those used in games of skill, and more particularly to a composite game dart capable of having its length and weight selectively adjusted.

The game of darts has received widespread publicity and is presently a competitive contest. In many countries as Great Britian, Canada and so on, dart throwers are viewed as national heroes and engage in extensive competition.

The darts used in such contests are relatively expensive and great care is taken in their manufacture and fabrication to assure true flight characteristics so that the users aim or ability is not affected by the flight capability of the dart.

As such, these darts are fabricated from materials as stainless steel, brass, tungsten and so on and are machined and produced to close tolerances and weights.

In any event, the weight and length of the dart are a prime factor in a user's selection. Many people who participate in the game of darts may prefer a lighter or heavier dart or may prefer the dart to be heavier at the point end and so on. Thus, there is really no standard set on weight and much reliance is placed on the preferences of the user, including such preferences as to length.

It is therefore an object of this invention to provide both an adjustable weight and length assembly, which is relatively economical to produce and simple to utilize.

BRIEF DESCRIPTION OF PREFERRED EMBODIMENT

A dart comprises a point end, a barrel shaft coupled to said point end and having positioned thereon a plurality of annular weight members, each having a central aperture slightly greater than the diameter of said shaft and emplaced thereon via said apertures and a flight accommodating section removeably secured to said shaft opposite said point end to retain said weights thereon.

BRIEF DESCRIPTION OF FIGURES

FIG. 1 is a plan view of a game dart according to this invention.

FIG. 2 is a lateral cross-sectional view of the dart shown in FIG. 1.

FIG. 3A is a top plan view of an annular weight used in the invention.

FIG. 3B is a side view of the weight of FIG. 3A.

FIG. 4 is an assembly diagram of the composite dart according to the invention.

DETAILED DESCRIPTION OF FIGURES

Referring to FIG. 1, there is shown a plan view of a throwing dart 10.

Essentially, the dart 10 may be about five inches long from the tip of the point 11 to the tip of the flight accommodating portion 12.

The central portion of the dart is referred to as the barrel 14. The length (L) of the barrel portion 14, as shown in the Figure, is about two inches, but can be adjusted with this invention.

The flight accommodating section or tail section 12 may be defined for purposes of this specification to extend from the end of the barrel portion 15 to the tip of section 12. The flight or feathers as 16 are accommodated by the flight section 12 and may be permanently or removeably secured thereto.

While the overall appearance of the dart 10 appears conventional, one notes that the barrel portion 14 has a plurality of annular rings associated therewith. As will be explained, the rings are formed due to the fact that the barrel portion is formed by emplacing a plurality of annular weights on a shaft secured to the top of the barrel assembly 14 or that part of the barrel assembly opposite to that accommodating the dart point 11. Each weight as 16 and 17 may be fabricated from a different density material such as stainless steel, brass, tungsten, aluminum or other materials.

Accordingly, all weights as 16 and 17 may be the same material or the materials may be different as selected by the user or manufacturer to thereby predetermine the overall weight of the dart. It is, of course, noted that the barrel assembly 14 is determinative of most of the dart weight.

In prior art darts, the barrel assembly was typically fabricated from a solid piece of material, such as brass or two attached pieces of different materials.

Referring to FIG. 2, there is shown a lateral cross section of the dart as 10 of FIG. 1.

The point 20 of the dart is fabricated from stainless steel or some other hard material and is approximately one inch long, shown as dimension A.

The end of the point is retained as soldered, welded, pressed or glued into the front end of a stainless steel barrel assembly 21. This, as shown is accomplished by an aperture 22 in the front end of assembly 21, it being understood that the piece may be integrally or otherwise formed. The barrel assembly has an extended shaft portion 23, which at the end furthest removed from the point 20, has a threaded section 24. A flight or tail assembly comprises a stainless steel or other hard metal cylinder 26 having a threaded central aperture 27.

The metal tail portion 26 is screwed on the threaded portion 24 of the barrel shaft member 23. A plastic or lighter material flight accommodating section 28 is also screwed into the cylinder 26 and this section 28 can accommodate the flight tail assembly or "feathers" as 30.

Intermediate and located about the barrel shaft 23 are a plurality of annular members as 31 to 35. Although the members are shown as five in number, more or less can be used, but generally four or five would be suitable. The members 30 to 35 are retained between the point end 21 and the flight section cylinder 26, due to the flanges shown in FIG. 2.

Each annular member as 31 to 35 may be fabricated from the same material as tungsten, steel, titanium, aluminum and so on, or may be a different material as depending upon the desires of the user or manufacturer. The members 31 to 35 have a central aperture to enable them to be emplaced on the shaft 23 or removed therefrom in a quick, easy and simple manner.

Referring to FIG. 3A, there is shown a top plan view of an annular weight member as 31; while FIG. 3B shows a side view. The central aperture as 40 is indicated as well.

To assure a tight fitting, a washer 41 may be included as shown in FIG. 2 or the assembly, if desired, may be permanently secured at the factory by means of a weld and so on, after a weight adjustment.

FIG. 3B shows a side view of the weight of FIG. 3A.

FIG. 4 shows an assembly view of the structure clearly indicating how the assembly composite dart assembly is placed together or taken apart. The front point accommodating end having the barrel portion 45, is unscrewed or otherwise removed from the coupling cylinder 46. The weights as 47 are then emplaced on the shaft 45, via their central apertures. One can now use any desired materials as brass, tungsten, stainless steel and so on to determine the weight and therefore the "feel" of the dart and the flight characteristics.

It is also noted that the dart shown is, in fact, easier and more economical to produce. This is so as it is much simpler to provide the assembly shown as the barrel portion comprises a plurality of annular weights. Each weight can be easily machined or pressed or otherwise fabricated eliminating machine time which was necessitated in the prior art to form a uniform barrel section from a single density material. The user, of course, can be supplied with a plurality of annular rings as 47 and 48 of different materials and therefore, can convert from a tungsten or heavy dart to a brass, aluminum or other dart as well as using some annular weights of one material and so on in a single composite assembly.

One can also readily ascertain that coupled with the advantages of having an adjustable weighted dart, one can also vary the length of the dart, if desired.

Hence, as shown in FIG. 2, the shaft portion 23 of the barrel may be longer than shown to accommodate additional weights, which, as above indicated, can be lighter or heavier material. Since each weight as 32, 33, 34 and 35 has a given width, the addition of more weights, as for example, six or seven can increase the length without an increase of weight or can increase or decrease both the length and weight. The additional length of the shaft 23 can be accommodated by having a longer screw thread in the cylinder 26.

Thus, one has both an adjustable weight and length dart to enable a user to accommodate his individual preferences.

Clearly understood is that the five weights shown are done so by way of example and more or less can be used to increase or decrease both the length and the weight of the dart.

We claim:

1. A dart comprising:

a. a shaft member terminating in one end in a point and an opposite end in a relatively long cylindrical member having a threaded portion furthest removed from said point, b. a plurality of annular weight members, each having a central aperture with said central apertures located about said cylindrical member between said pointed and said threaded portion, at least one of said weights fabricated from a different density metal than another, but being relatively of the same dimensions, c. a washer emplaced on said threaded portion and in proximity with the last one of said weights furthest removed from said point end, d. a metallic cylindrical coupling member having a first threaded aperture in one end for coacting with said threaded portion of said long cylindrical member to retain said weights on said shaft member while permitting selective removal or addition of the same, a second threaded aperture relatively colinear with said first and located at an opposite end of said cylindrical member, whereby the central portion of said cylindrical member is solid metal, e. a flight accommodating section of a longer length than said coupling member and fabricated from a material which is substantially lighter than any material used in said shaft member and said annular weights, said section having a front threaded shaft for coacting with said second aperture in said cylindrical coupling member and having at an opposite end, a plurality of radially extending flight control means.

2. The dart according to claim 1 wherein at least one of said weights is fabricated from tungsten and at least another from brass.

3. The dart according to claim 1 wherein said flight accommodating section is fabricated from a plastic.

* * * * *